United States Patent [19]

Mazur et al.

[11] 3,978,622

[45] Sept. 7, 1976

[54] LAPPING AND POLISHING APPARATUS

[75] Inventors: Robert G. Mazur, Monroeville; Gilbert A. Gruber, Pittsburgh; Robert C. Stephenson, North Irwin, all of Pa.

[73] Assignee: Solid State Measurements, Inc., Monroeville, Pa.

[22] Filed: July 23, 1975

[21] Appl. No.: 598,181

[52] U.S. Cl. ..... 51/119

[51] Int. Cl.[2] ..... B24B 7/00

[58] Field of Search ..... 51/58, 119, 6, DIG. 6

[56] References Cited

UNITED STATES PATENTS

| | | | |
|---|---|---|---|
| 2,192,233 | 3/1940 | Mack | 51/6 |
| 2,412,141 | 12/1946 | Ford | 51/119 |
| 3,061,981 | 11/1962 | Banta | 51/119 |
| 3,277,610 | 10/1966 | Mazur | 51/119 |

*Primary Examiner*—Al Lawrence Smith
*Assistant Examiner*—Robert C. Watson
*Attorney, Agent, or Firm*—Brown, Murray, Flick & Peckham

[57] ABSTRACT

Apparatus for abrading workpieces, particularly semiconductor wafers, characterized in that the workpiece is disposed on an abrading material in a lapping and polishing tray carried on a generally horizontal support plate. The plate is caused to oscillate or eccentrically rotate by a single, centrally located eccentric arm, the plate being restrained against rotary movement about the eccentric arm by resilient means which extend between stationary pins arranged around the support plate and points on the support plate intermediate the pins.

7 Claims, 7 Drawing Figures

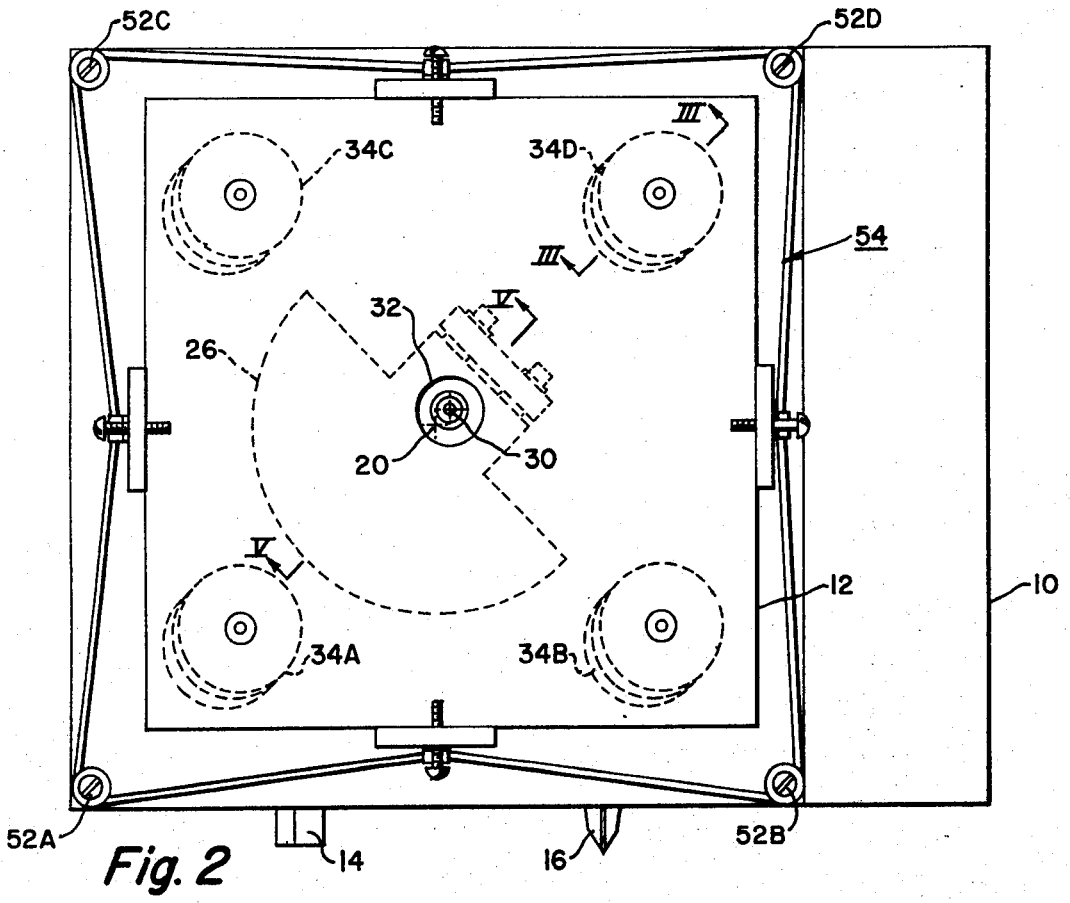
Fig. 2
Fig. 7
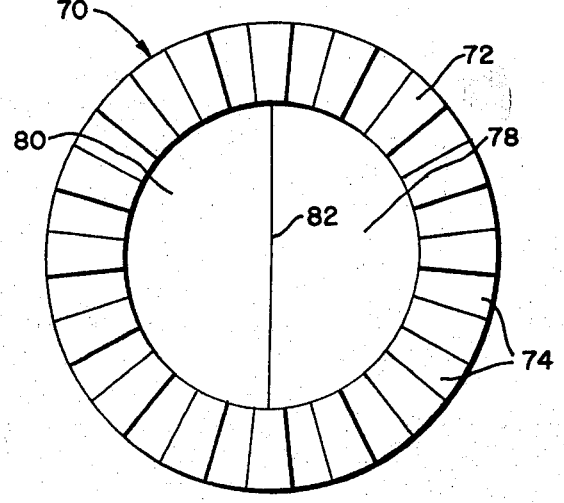
Fig. 6
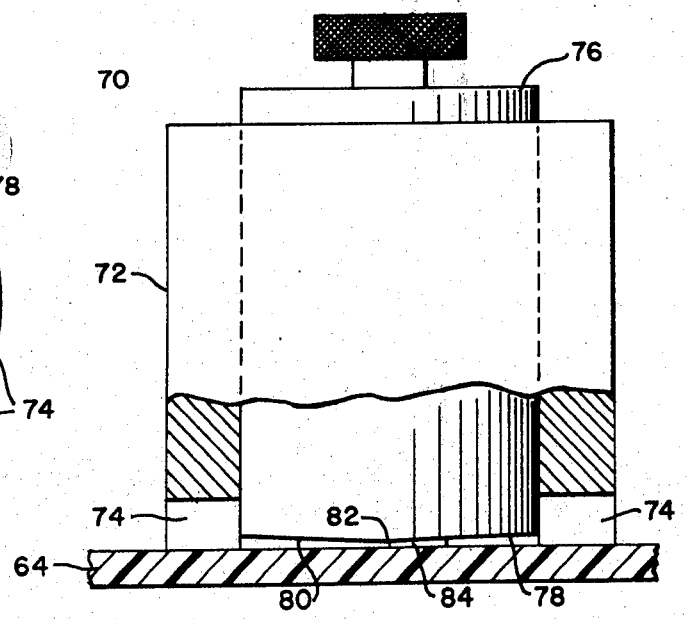

LAPPING AND POLISHING APPARATUS

BACKGROUND OF THE INVENTION

While not limited thereto, the present invention is particularly adapted for use in lapping and polishing samples of semiconductive material for use in determining spreading resistance, resistivity and impurity concentration in the semiconductive sample. The technique for determining these parameters is described in Mazur U.S. Pat. No. 3,628,137. By reference to that patent, it will be appreciated that it is necessary to lap the semiconductive sample to provide a surface which is at an angle with respect to the top of the wafer in order that spreading resistance, for example, can be determined throughout the thickness of the sample. It should be understood, however, that while the invention described herein has particular utility in connection with the lapping of semiconductive bodies, it can be used in any lapping and/or polishing operation.

Apparatus for lapping and polishing semiconductive samples and the like is shown, for instance, in Mazur U.S. Pat. No. 3,277,610. The apparatus described in that patent includes a metal plate which is driven via a plurality of eccentric arms in a motion which may be described as an "eccentric rotation", with each point on the plate moving in a circular path about some other point in the plane of the plate. The motion can perhaps better be thought of as a circular translation of the driven plate. Removable trays are affixed to the moving plate with each tray containing a glass plate or other suitable lapping or polishing surface, an abrasive on the plate, and one or more elastic fixtures to improve control of the motion of one or more workpiece-holding jigs placed on the lapping or polishing plate. The combined effects of the inherent inertia of the lapping jigs and the low frictional force between the jig and the lapping or polishing surface cause a relative motion between samples affixed to the jigs and the lapping or polishing surface, resulting in abrasion of the sample surfaces.

In the apparatus shown in the aforesaid U.S. Pat. No. 3,277,610, eccentric arms are provided at the four corners of the support plate for the tray. Four eccentric arms of this type were believed to be necessary to prevent excessive vibration due to the off-balanced eccentrically rotating mass of the moving plate and its attachments. However, a disadvantage of this prior art arrangement is that only one of the four eccentric shafts is actually motor driven, the others being forced to follow the motion of the driven shaft. This system results in excessive wear of the bearings used in the non-motor-driven eccentric arms because of a lateral hammering effect. Attempts have also been made to drive all four eccentric arms from a single drive motor through suitable bevel gearing. This arrangement, however, has not proved to be altogether satisfactory.

SUMMARY OF THE INVENTION

In accordance with the present invention, a new and improved apparatus for abrading workpieces of the general type described above is provided wherein the aforesaid support plate is driven by a single, centrally located eccentric arm; while rotation of the support plate about its connection to the eccentric arm is prevented by means of resilient bands extending between stationary pins spaced about the support plate and points on the support plate intermediate those pins.

Specifically, there is provided in accordance with the invention drive motor means having a vertical, rotatable shaft. An eccentric arm is connected to the rotatable shaft and is centrally connected to a support plate at a point removed from the shaft whereby rotation of the shaft will effect an oscillatory, eccentric movement of the support plate in a generally horizontal plane. Pins are arranged about the support plate, preferably in quadrature; while resilient means connect the respective pin means to points on the support plate intermediate the pin means. In this manner, the plate will move in a horizontal plane in a truly eccentric rotational movement without rotating about its connection to the eccentric arm.

The support plate is preferably rectangular in configuration and is supported at its four corners by means of ball bearing thrust bearings which are vertically loaded only. A bearing system of this type is inherently long-wearing since each of the sets of balls is normally used in a standard thrustwasher rated for 145 pounds thrust at 500 revolutions per minute. As a result, the four bearings can support a total of about 600 pounds at 500 revolutions per minute. The actual loads are considerably less than this, resulting in long bearing life.

The remainder of the apparatus is essentially the same as that shown by the prior art. That is, a lapping and polishing tray is disposed on the support plate whereby a workpiece on the tray will be oscillated in a random manner due to the eccentric movement of the support plate and tray to abrade the surface of a workpiece in contact with the tray. Preferably, the workpiece is carried on a jig or fixture which is weighted in order to press a surface of the workpiece against a lapping surface within the support tray.

The above and other objects and features of the invention will become apparent from the following detailed description taken in connection with the accompanying drawings which form a part of this specification, and in which:

FIG. 2 is a top view of the lapping and polishing apparatus of the invention with the polishing tray removed;

FIG. 6 is a partially broken-away plan view of a jig for holding a workpiece to be lapped and polished; and FIG. 7 is a bottom view of the jig shown in FIG. 6.

Figure 1:
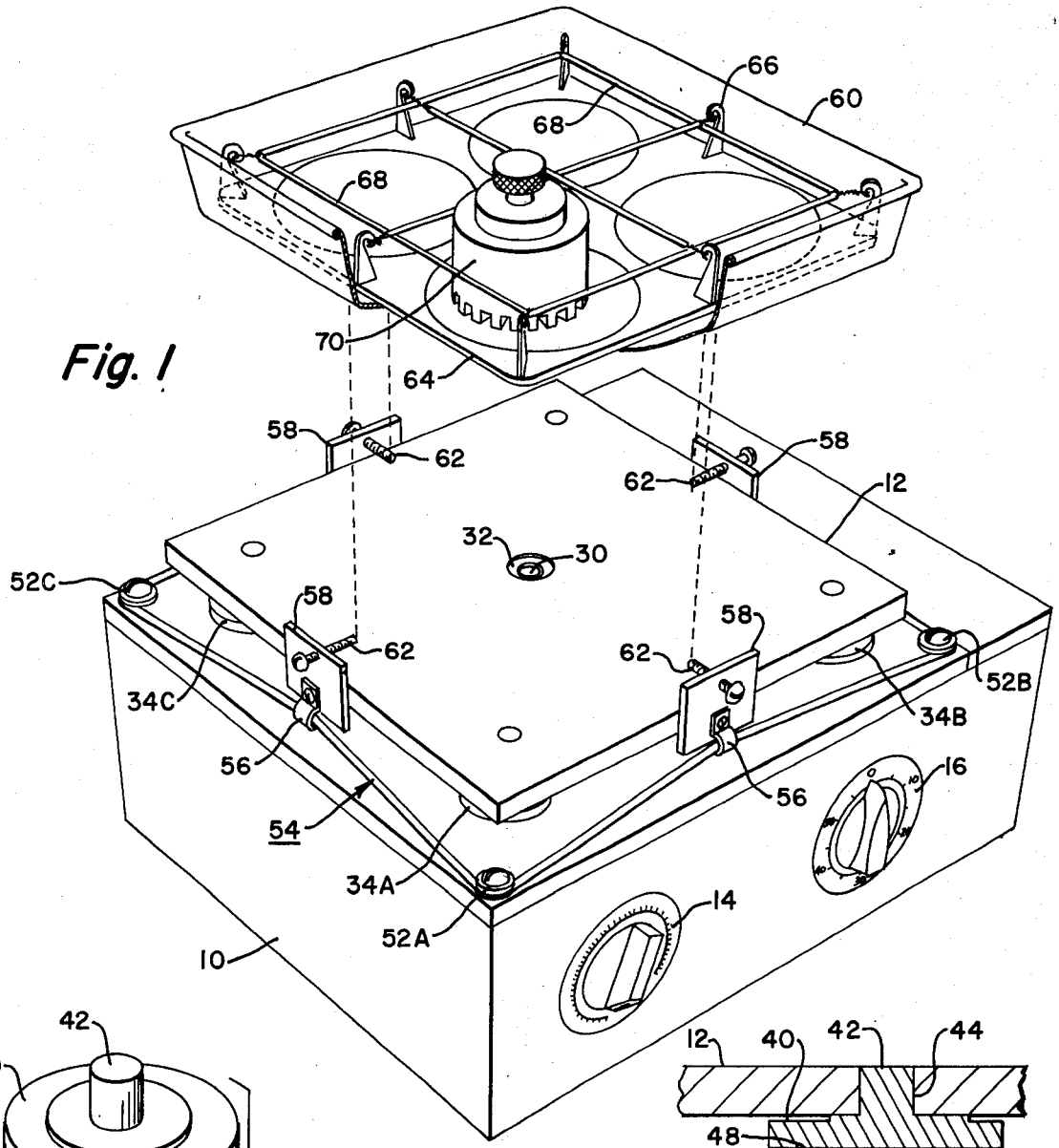
FIG. 1 is an exploded and partially broken-away perspective view of the polishing and lapping apparatus of the invention.

With reference now to the drawings, and particularly to FIG. 1, the lapping and polishing apparatus shown includes a housing 10 which carries a drive motor, not shown, for causing oscillation or eccentric rotation of a generally horizontal support plate 12. The housing 10 has mounted thereon two controls 14 and 16. Control 14 is utilized to control the speed of the drive motor; while control 16 comprises a timer by which the period of eccentric rotation of the support plate 12 can be controlled.

Figure 4:
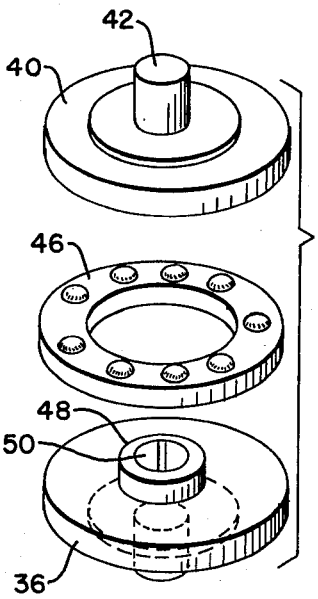
FIG. 4 is an exploded view of the thrust bearing construction of the invention.
Figure 5:
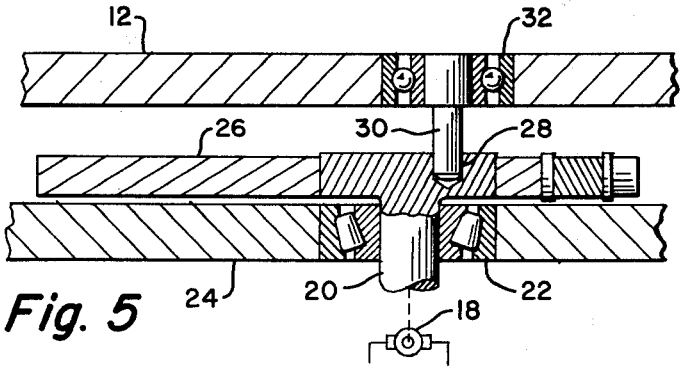
FIG. 5 is a cross-sectional view taken substantially along line V—V of FIG. 2 showing the details of the eccentric arm of the invention which oscillates the support plate for a lapping tray.

Before proceeding with the description of FIG. 1, reference will be had to FIGS. 2–5. In FIG. 5, a drive motor 18 is shown connected to a shaft 20 mounted in a thrust bearing 22. The thrust bearing 22, in turn, is carried by an upper covering plate 24 of the housing 10. Mounted on the upper end of the shaft 20 is a counterweight 26 having a bore 28 offset with respect to the axis of the shaft 20. Received within the bore 28 is a shaft 30 mounted within bearing 32 located at the center of the support plate 12. As will be understood, shaft 20 and the offset shaft 30 comprise an eccentric arm arrangement which causes the plate 12 to rotate in an oscillatory or eccentric rotational manner as will hereinafter be described.

Figure 3:
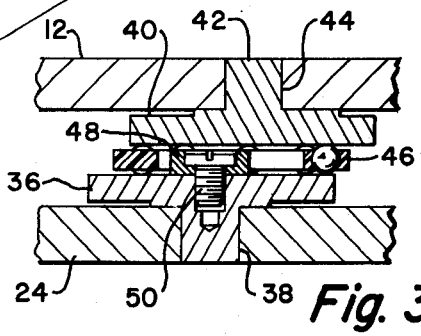
FIG. 3 is a cross-sectional view taken substantially along line III—III of FIG. 2 showing the thrust bearing construction of the invention in cross section.

In order to support the four corners of the support plate 12, four ball bearing thrust bearings are provided at its four corners and identified by the reference numerals 34A, 34B, 34C and 34D. The details of the thrust bearings are shown in FIGS. 3 and 4. Each comprises a lower washer 36 carried within a bore 38 in the upper plate 24 of housing 10, together with an upper washer 40 provided with a pin or projection 42 carried within a bore 44 in the support plate 12. Intermediate the two washers 36 and 40 is a ball bearing race 46. In order to prevent the ball bearing race 46 from moving out from between the two washers 36 and 40, a collar 48 is centrally secured to the washer 36 by means of screw 50 such that the outer periphery of the washer 48 will engage the inner periphery of the ball race 46 and limit its lateral movement in a horizontal plane. At the same time, the upper washer 40 and the plate 12 on which it is carried can freely oscillate in a rotary, eccentric motion about the lower washer 36.

As will be appreciated, the apparatus thus far described would result in an arrangement wherein the support plate 12 could rotate about the axis of the pin 30; whereas it is desired that the plate 12 oscillate in a rotary eccentric movement while preventing rotation of the plate 12 about the axis of pin 30. In order to achieve this result, and as best shown in FIGS. 1 and 2, four pins 52A, 52B, 52C and 52D are provided in the upper plate 24 of the housing 10 at the four corners of the support plate 12. Extending around these pins 52A-52D is an elastic band 54 connected to the sides of the support plate 12 intermediate each set of pins by means of clamps or brackets 56, perhaps best shown in FIG. 1. The brackets 56 are carried on upstanding plates 58 which, in turn, are secured to the four sides of the support plate 12. The brackets 56 are preferably intermediate the pins 52A, 52B, for example. The elastic band 54 may be formed from rubber or some other elastomer having sufficient resiliency to permit the support plate 12 to eccentrically rotate while preventing rotation of the plate itself about the pin 30. The assembly thus eliminates the need for a plurality of eccentric arms and at the same time restrains the plate 12 against rotation about the axis of the pin 30 which is essential to achieve the desired eccentric rotational movement of the plate 12.

During a lapping and/or polishing operation, a lapping and polishing tray 60 (FIG. 1) is mounted on the support plate 12 and secured thereto by means of screws 62 extending through the upstanding plates 58; however any type of fastening means can be utilized, depending upon requirements. Carried at the bottom of the tray 60 is a plate 64 on which the lapping and/or polishing operation is actually performed. In the case of a lapping operation, the plate 64 preferably comprises glass; whereas when polishing is desired, the plate 64 is preferably formed from an acrylic plastic or the like. The inner walls of the tray 60 have secured thereto upstanding hooks 66. Between the hooks 66 extend elastic bands 68 to divide the tray into four quadrants. The number of sections into which the tray is divided is immaterial and, for that matter, it need not be sectioned; however four quadrants enable four lapping or polishing operations to be carried on simultaneously. A suitable abrasive is deposited on the plate 64; and a workpiece to be lapped or polished is mounted on a fixture 70 which can oscillate within an associated one of the quadrants.

The fixture 70 is shown in FIGS. 6 and 7. It comprises an outer cylindrical casing 72 having slots 74 provided at its lower end to permit an abrading or polishing material on the surface of the lapping plate 64 to pass into the interior of the cylindrical casing 72. Carried within the housing 72 is a solid, cylindrical workpiece carrier 76 which, in the embodiment of the invention shown herein, has a lower surface comprising two flat areas 78 and 80 which slope upwardly from a center line 82. By positioning a workpiece 84 on one of the two sloped areas 78 or 80, therefore, a beveled surface will be produced on the workpiece in the lapping process. Assuming that the workpiece is a semiconductor wafer, the resulting lapped surface will expose a portion of the cross section of the wafer in order that spreading resistance measurements can be made as described, for example, in U.S. Pat. No. 3,628,137. The invention, however, has application to any lapping and polishing operation, whether a beveled surface is required or otherwise.

In operation, the workpiece 84 is secured to the lower surface of the workpiece carrier 76. In the case of a semiconductor wafer, the adhesive used is preferably a mixture of beeswax and rosin. After the workpiece is affixed to the lower surface of the carrier 76, the carrier is inserted into the cylindrical housing 72 and placed within one of the quadrants bounded by the elastic bands 68 shown in FIG. 1. However, before the workpiece (carried on the workpiece carrier 76) is deposited on the plate 64, a suitable abrasive material, preferably in slurry form, is deposited on the plate 64 beneath the workpiece. Thereafter, the motor 18 connected to the shaft 20 is energized; and the plate 12 is caused to eccentrically rotate as described above. During this movement of the plate 12, the fixture 70 with the workpiece affixed to the carrier 76 will randomly oscillate within its associated quadrant, periodically bouncing off the elastic bands 68. The result is a shuffling, random movement of the fixture 70 and the workpiece 84 which effects a lapping and/or polishing operation on the workpiece.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. Apparatus for abrading a workpiece comprising drive motor means provided with a vertical rotatable shaft having connected thereto an eccentric arm, a support plate centrally connected to said eccentric arm at a point removed from said shaft whereby rotation of said shaft will effect an oscillatory eccentric movement of said support plate in a generally horizontal plane, stationary pin means arranged at spaced points around the periphery of said support plate, resilient means connecting the respective pin means to points on the support plate intermediate the pin means, and a lapping and polishing tray disposed on said support plate whereby a workpiece on the tray will be oscillated in a random manner due to the eccentric movement of the support plate and tray to abrade the surface of the workpiece in contact with the tray.

2. The apparatus of claim 1 wherein said support plate is generally rectangular in configuration and said pin means are arranged in quadrature of the four corners of the rectangular support plate.

3. The apparatus of claim 1 wherein said resilient means comprises an elastic band connecting the pin means to points on said support plate intermediate the pin means.

4. The apparatus of claim 1 including a second generally horizontal and stationary plate beneath said support plate, and ball bearing thrust bearings spaced around said eccentric arm and interposed between said latter-mentioned plate and said support plate.

5. The apparatus of claim 4 wherein said ball bearing thrust bearings each comprises a first washer secured to said second plate, a second washer connected to the underside of said support plate, and a ball bearing race interposed between said washers.

6. The apparatus of claim 5 including a centrally disposed, generally circuit element projecting from at least one of said washers and into the interior of said bearing race to limit lateral movement of the bearing race between said washers.

7. The apparatus of claim 2 including means for securing said lapping and polishing tray to said support plate, said latter means also serving to secure said resilient means to points on the support plate intermediate the pin means.

* * * * *